US009380367B2

(12) United States Patent
Gebert et al.

(10) Patent No.: US 9,380,367 B2
(45) Date of Patent: Jun. 28, 2016

(54) MICROPHONE PROTECTIVE DEVICE

(75) Inventors: Anton Gebert, Kleinsendelbach (DE); Marco Lederer, Hirschaid/Erlach (DE)

(73) Assignee: Sivantos Pte. Ltd., Singapore (SG)

( * ) Notice: Subject to any disclaimer, the term of this patent is extended or adjusted under 35 U.S.C. 154(b) by 476 days.

(21) Appl. No.: 13/817,998

(22) PCT Filed: Aug. 20, 2010

(86) PCT No.: PCT/EP2010/062172

§ 371 (c)(1),
(2), (4) Date: Feb. 20, 2013

(87) PCT Pub. No.: WO2012/022382

PCT Pub. Date: Feb. 23, 2012

(65) Prior Publication Data

US 2013/0148832 A1 Jun. 13, 2013

(51) Int. Cl.
*H04R 1/04* (2006.01)
*H04R 25/00* (2006.01)

(52) U.S. Cl.
CPC ..... *H04R 1/04* (2013.01); *H04R 25/65* (2013.01); *H04R 25/654* (2013.01); *H04R 25/604* (2013.01)

(58) Field of Classification Search
CPC ..... H04R 1/04
USPC ..... 381/322, 324
See application file for complete search history.

(56) References Cited

U.S. PATENT DOCUMENTS

| | | | | |
|---|---|---|---|---|
| 4,987,597 | A | 1/1991 | Haertl | |
| 2006/0215863 | A1* | 9/2006 | Sauer | 381/324 |
| 2006/0239485 | A1* | 10/2006 | Niederdrank | H04R 25/654 381/328 |
| 2007/0003087 | A1* | 1/2007 | Ram et al. | 381/328 |
| 2008/0095390 | A1 | 4/2008 | Gebert et al. | |
| 2010/0086159 | A1 | 4/2010 | Gabathuler et al. | |
| 2011/0280423 | A1* | 11/2011 | Nielsen | H04R 25/608 381/317 |

FOREIGN PATENT DOCUMENTS

| | | | |
|---|---|---|---|
| CN | 101272638 | A | 9/2008 |
| DE | 102007034230 | A1 | 1/2009 |
| EP | 0310866 | A1 | 4/1989 |
| WO | 2008116500 | A1 | 10/2008 |

* cited by examiner

*Primary Examiner* — Duc Nguyen
*Assistant Examiner* — Phan Le
(74) *Attorney, Agent, or Firm* — Laurence A. Greenberg; Werner H. Stemer; Ralph E. Locher

(57) ABSTRACT

In order to protect a microphone from moisture and/or dirt, there is provided a microphone protective device that needs only relatively little space for installation into an electroacoustic device for a relatively large effective surface area. For this purpose, the novel microphone protective device has an at least partially cylindrical-shell-shaped membrane, for preventing dirt and/or moisture from entering a sound inlet opening of the microphone.

19 Claims, 3 Drawing Sheets

MICROPHONE PROTECTIVE DEVICE

BACKGROUND OF THE INVENTION

Field of the Invention

The invention relates to a microphone protective device for preventing the entry of dirt and/or moisture into a sound inlet opening of a microphone, comprising a dirt and/or moisture-repelling membrane and/or a membrane impermeable to dirt and/or moisture.

The invention further relates to a hearing aid device with a corresponding microphone protective device as well as a microphone unit with a microphone and a microphone protective device.

The microphone protective device is designed to prevent the entry of dirt and/or moisture into a microphone as completely as possible. Furthermore the microphone protective device should attenuate an acoustic input signal into the microphone as little as possible. Above and beyond this the microphone protective device should remain effective for as long as possible and especially not clog up. These requirements can only be fulfilled if a comparatively large surface is provided for the membrane of the microphone protective device. However this runs counter to the aim of miniaturization of hearing aid devices. In particular with hearing aid devices with a number of microphones, only a relatively narrowly restricted area can be made available for each microphone for the microphone protective device on the housing surface of the hearing aid device.

Microphone protective devices are known which have a grating provided with a water-repellent coating. Although these only have a slight attenuation, they only provide a comparatively small water head for this as regards water tightness.

Furthermore microphone protective devices with flat, (micro) porous membranes are known, which make a high water column possible, but need a relatively large membrane surface for a low attenuation. E.g. publication EP 310 866 A1 describes a microphone protective device with a membrane made of Gore-Tex Material impermeable to dirt and water.

BRIEF SUMMARY OF THE INVENTION

The object of the present invention is to specify a microphone protective device, especially for a hearing aid device which, with a comparatively low space requirement, provides a high level of waterproofing and low acoustic attenuation.

This object is achieved by a microphone protective device with the features as claimed.

The microphone protective device according to the invention comprises a dirt and/or moisture-repelling or dirt and/or water-impermeable membrane, which prevents the entry of dirt and/or moisture into the microphone. In this case the membrane is embodied at least in parts in a cylindrical shell shape or is disposed on a cylindrical shell surface for achieving a comparatively large surface with low space requirements on the housing surface of an electro-acoustic device for which the microphone protective device is provided.

In connection with the invention "cylindrical-shell-shaped" or "cylindrical", means that at least one part of the membrane forms a cylindrical shell. The base surface of the cylinder can have any given form. Advantageous however are a circular, rectangular, especially square, or elliptical base surface. A cavity, which however has at least one open side, i.e. not enclosed by the membrane, is thus formed by the membrane. The membrane thus does not form a completely closed cylindrical surface. Preferably the at least one open side is also not closed off by another material or cover element. As an alternative the open side can however also be covered for example by a "large-mesh" grating compared with the grating. The open side is the base and/or the cover surface of the cylinder formed by the membrane. The cylindrical shell design can be produced for example by a flat, rectangular membrane being rolled up.

As an alternative to the direct cylindrical-shell-shaped embodiment of the membrane, at least one membrane which does not form a complete cylindrical shell can be applied to a carrier, especially a cylindrical-shell-shaped carrier, so that the membrane lies on a cylindrical shell surface or at least partly forms this surface. For example in this way a number of "small" membranes can be disposed on a cylindrical-shell-shaped carrier. The carrier in this case is permeable to air and also acoustically transparent at least partly in sections, especially in the area of the membranes.

The invention offers the advantage that at least essentially only space is needed on the housing surface of the electro-acoustic device for the membrane protection device for an (open) end (base or cover surface of the cylinder) of the membrane embodied in a cylindrical shell shape. This makes it possible to reduce the space required on the housing surface of the electro-acoustic device, although a comparatively large effective surface of the membrane is effective in protecting the microphone.

Preferably the microphone protective device as a unit is embodied from a likewise cylindrical-shell-shaped outer envelope and the membrane disposed therein. The microphone protective device thus has the structure of a double-wall tube. The outer envelope in this case preferably acts as a membrane carrier. The membrane carrier simplifies the fitting and the replacement of the membrane in relation to an electro-acoustic device.

By the outer envelope having a greater diameter than the membrane surrounded thereby, the membrane and the outer envelope are advantageously able to be spaced apart from one another. They preferably have the same axis of symmetry. At the ends of the tubular membrane or envelope the area between the membrane and the envelope is preferably closed off, e.g. through correspondingly shaped sections on the envelope, so that neither dirt nor moisture can penetrate into the space between the membrane and the envelope.

To prevent the membrane coming into contact with the envelope, the area between the membrane and the envelope can also be filled with an acoustically-transparent material, for example an expanded foam.

In order to further prevent the penetration of dirt into an open end of the membrane embodied in a cylindrical shell shape, the open end can also be provided with a protective cover preferably embodied in an essentially disk shape. This protective cover consists e.g. of a comparatively coarse protective grating compared to the membrane, which prevents coarse dirt particles reaching the membrane.

To connect the microphone protective device to a microphone a microphone connection opening is advantageously located in the outer envelope of the microphone protective device.

The inventive microphone protective device is particularly well suited for installation in a hearing aid device, since in hearing aid devices in general the aim is to miniaturize the devices as much as possible and the microphone protective device in accordance with the invention only occupies relatively little space on the surface of the housing of a hearing aid device concerned. The inventive microphone protective device is however not restricted to installation in a hearing aid device. Instead said device can also be built into other electro-acoustic devices, especially communication devices such as mobile telephones, headsets, PDAs etc.

In particular with a hearing aid device able to be worn behind the ear, with a housing with a left housing side and a right housing side embodied symmetrically thereto, a microphone protective device in accordance with the invention can be built into the hearing aid device and dimensioned such that a first open end of the membrane embodied in the shape of a cylindrical shell opens out into the left housing side and a second end of the membrane embodied in the shape of a cylindrical shell opens out into the right housing side of the hearing aid device concerned. The membrane thus has the shape of a tube open on both sides. The membrane embodied in the shape of the tube thus forms a channel through the hearing device from one housing side to the other. This has the advantage that a membrane embodied in this way is especially easy to clean and to replace if required. A suitable tool can then be especially easily inserted into the channel formed by the membrane, namely for cleaning or replacing the membrane. Different hearing aid devices for supplying the left or the right here can then be created in a simple manner by the respective microphone openings being closed on one housing side e.g. glued over.

In an embodiment of the invention the envelope surrounding the membrane of the microphone protective device is embodied in one piece with the housing of the hearing aid device. The membrane is then inserted, e.g. glued into the correspondingly embodied completed housing.

A further embodiment of the invention provides for a microphone unit with a microphone and a microphone protective device connected thereto in accordance with the invention to have one unit.

BRIEF DESCRIPTION OF THE SEVERAL VIEWS OF THE DRAWING

The invention will be explained in greater detail below with reference to the exemplary embodiments, in which.

DESCRIPTION OF THE INVENTION

Figure 1:
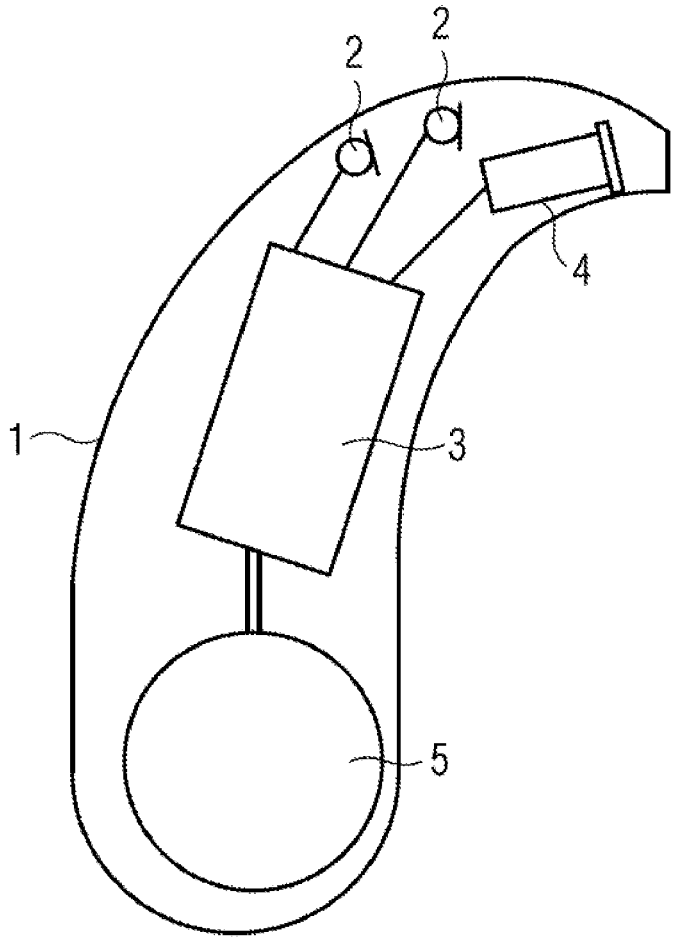
FIG 1 PRIOR ART
FIG. 1 shows a hearing aid device in accordance with the prior art in a block diagram.

FIG. 1 shows a typical structure of a hearing aid device in a greatly simplified block diagram, especially of a hearing aid device able to be worn behind the ear, in accordance with the prior art. As their basic components, hearing aid devices essentially comprise an input converter, an amplifier and an output converter. The input converter is generally a sound receiver, e.g. a microphone and/or an electromagnetic receiver, e.g. an induction coil. The output converter is mostly realized as an electro-acoustic converter, e.g. miniature loudspeaker or receiver, or as an electromechanical converter, e.g. bone-conduction receiver. The amplifier is usually integrated into a signal processing unit. One or more microphones 2 for picking up the sound from the environment, in the exemplary embodiment in accordance with FIG. 1, are built into a hearing aid device housing 1 designed to be worn behind the ear. A signal processing unit 3, which is likewise located in the hearing aid housing 1, processes the microphone signals and amplifies them. The output signals of the signal processing unit 3 are transmitted to a loudspeaker or receiver 4 respectively which outputs an acoustic signal. The sound is transmitted to the eardrum of the user if necessary by a sound tube which is fixed with an otoplastic in the auditory canal. The hearing device and especially the signal processing unit 3 are supplied with energy by a battery 5 likewise disposed in the hearing device housing 1.

Figure 2:
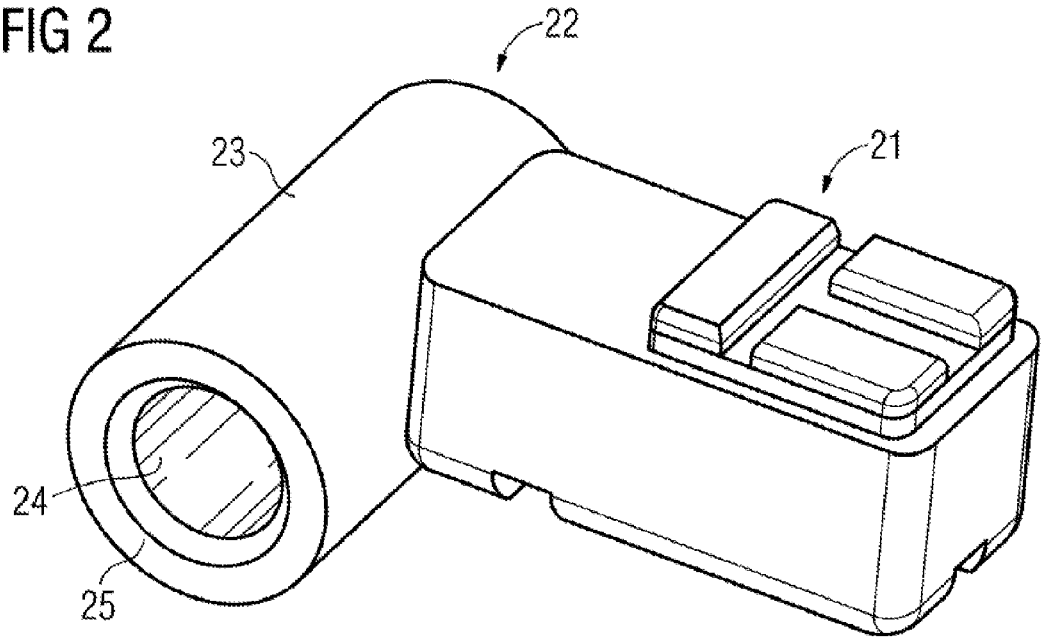
FIG. 2 shows a microphone protective device in accordance with the invention and a microphone connected thereto.

FIG. 2 shows a microphone unit with a microphone 21 and a microphone protective device 22 permanently connected thereto in accordance with the invention. The microphone protective device 22 comprises a cylindrical-shell-shaped envelope 23 consisting of a material impermeable to air and also a membrane 24 disposed inside the envelope 23 and also embodied in the shape of a cylindrical shell. The envelope 23 and the membrane 24, in the exemplary embodiment, have the same axis of symmetry and their cross sections are concentric circles. Located in the area between a front end of the cylindrical-shell-shaped membrane 24 and the cylindrical-shell-shaped envelope 23 is an essentially disk-shaped area 25 embodied in one piece with the envelope 23, which prevents the penetration of dirt or moisture into the space between the cylindrical-shell-shaped envelope 23 and the cylindrical-shell-shaped membrane 24. The disk-shaped area 25 also serves to attach the membrane 24 within the envelope 23.

In a state in which the microphone protective device 22 is built into an electro-acoustic device, especially a hearing aid device, essentially only the space for the open end of the membrane 24 embodied in the shape of a cylindrical shell visible from FIG. 2 is needed on the device surface. The effective surface of the microphone protective device 22 is thus displaced into the device. The space requirement on the housing surface is thus small by comparison with the effective surface of the membrane 24.

Figure 3:
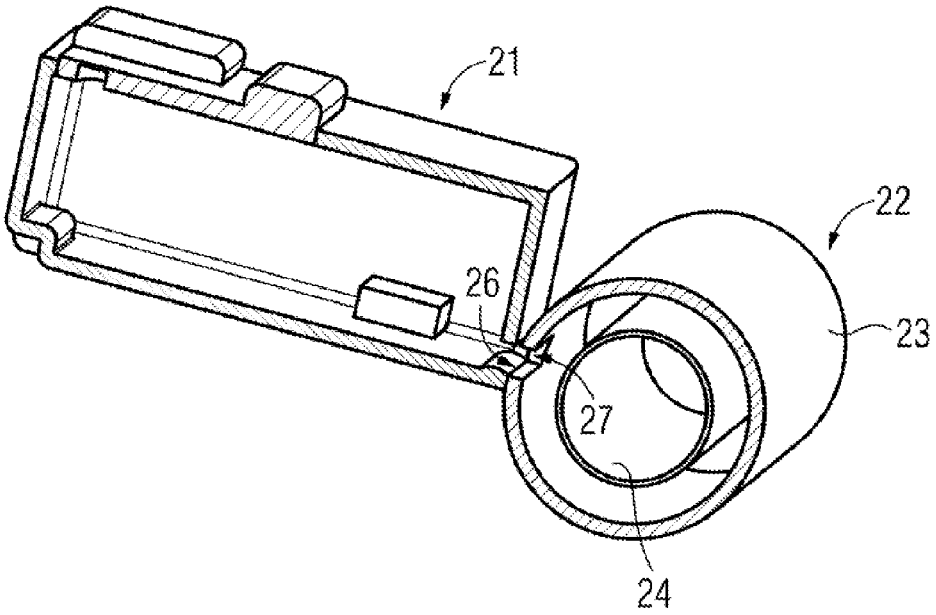
FIG. 3 shows a microphone protective device and a microphone connected thereto in a cross-sectional diagram.

The structure of the microphone protective device 22 and the connection to the microphone 21 are further illustrated by the cross-sectional diagram in accordance with FIG. 3. In particular FIG. 3 shows the arrangement of the membrane 24 embodied in the shape of a cylindrical shell within the envelope 23 likewise embodied in the shape of a cylindrical shell. The distance between the membrane 24 and the envelope 23 and the space embodied thereby means that almost the entire surface of the membrane 24 is effective for protection against the penetration of dirt or moisture into the microphone 21. Typical diameters of the membrane 24 embodied in the shape of a cylindrical shell, especially with a circular cross-section with a least one open end face side of the cylinder, range for hearing device applications from 1 mm to 1.5 mm. Typical diameters of the envelope 23 range from 1.5 mm to 2.5 mm. The height of the cylindrical shell formed by the membrane ranges for hearing device applications from 2 mm to 6 mm. The height of the cylindrical-shell-shaped envelope can slightly exceed the height of the membrane if necessary.

FIG. 3 also shows the sound inlet opening 26 of the microphone 21 and a microphone connection opening 27 in the envelope 23 of the microphone protective device 22 connected thereto. The sound is conducted by these two openings from the microphone protective device 22 to the microphone 21.

Figure 4:
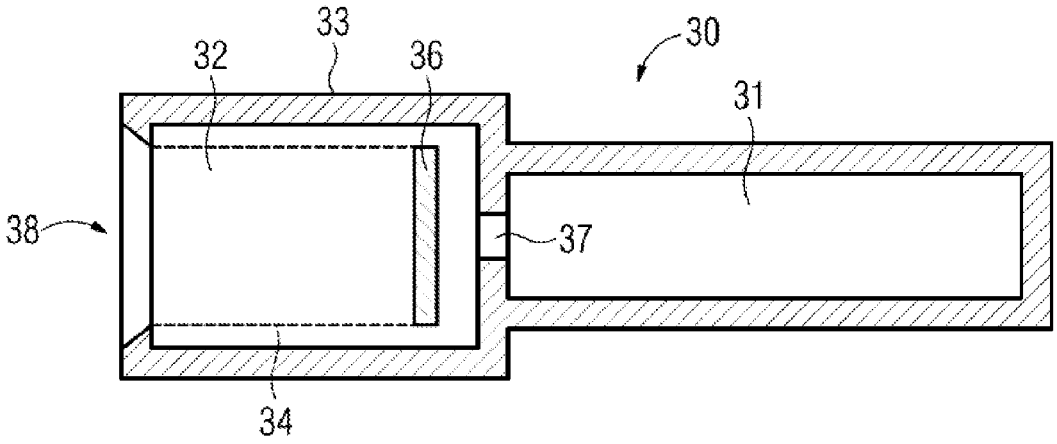
FIG. 4 shows a further embodiment of a microphone protective device in accordance with the invention.

FIG. 4 shows a schematic diagram of another embodiment of a microphone unit 30 in accordance with the invention, which is essentially made up of a microphone 31 and a microphone protective device 32. Unlike in the previous exemplary embodiment, here the microphone protective device 32 and the microphone 31 are both joined together in the longitudinal direction. This means that the axis of symmetry in the longitudinal direction of the microphone 31 and the axis of symmetry of the microphone protective device 32 run in parallel or even coincide. Sound entering via a sound inlet opening 38 into the microphone unit 30 must initially pass through the membrane 34 in order to reach a hollow space between the outer envelope 33 of the microphone protective device 32 and the membrane 34. In the direction towards the microphone 31 this hollow space is closed off by a terminating element 36 impermeable to air. Air and thereby sound can therefore only get through the membrane 34 and subsequently via the microphone connection opening 37 into the microphone 31. As a further special feature, in addition to the alignment of the microphone protective device 32 in relation to the microphone 31, the housing of the microphone unit 30, which comprises the outer envelope 33 of the microphone protective device 32, is embodied in one piece.

As well as the advantages already stated, the inventive microphone protective device also offers the advantage that vibrations exerted on the microphone protective device and especially its membrane, which for example, with a microphone protective device disposed in a hearing aid device, can be transmitted from a receiver likewise disposed there, can be largely compensated for. Thus for a movement at right angles to the axis of symmetry of the cylindrical-shell-shaped membrane, a part area of the membrane relative to the envelope is moved towards the envelope and a second part area of the envelope opposite this part area within the envelope is moved away from the envelope. In this way movements transmitted to the membrane by the movement (vibration) of the envelope are mutually compensated for in respect of their effect.

Figure 5:
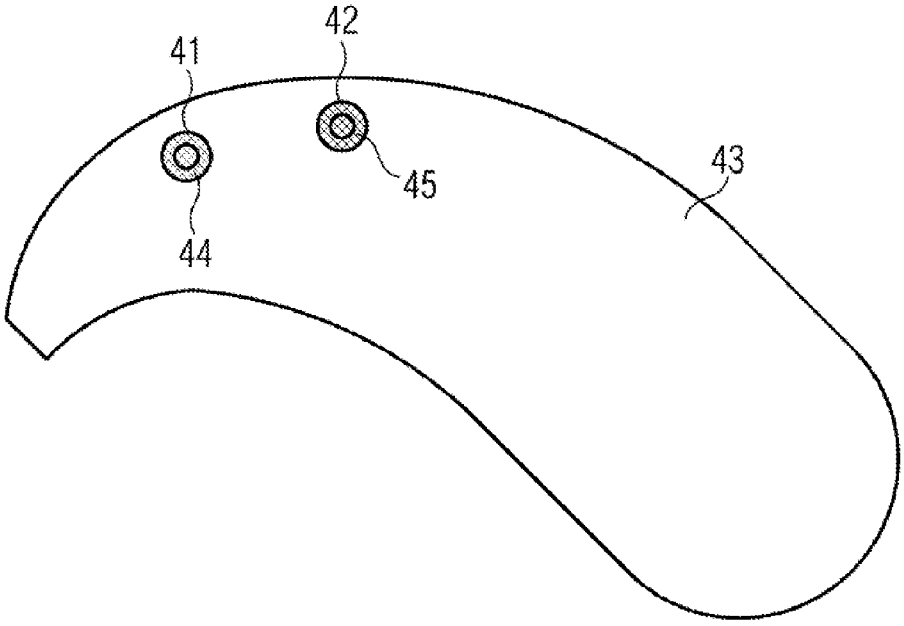
FIG. 5 shows a hearing aid device with a built-in microphone protective device in accordance with the invention.

FIG. 5 shows two inventive microphone protective devices 41 and 42, which are built into a hearing aid device 43 able to be worn behind the ear. To prevent the penetration of larger dirt particles into the sound entry openings in the housing of the hearing aid device 43 formed by the cylindrical-shell-shaped membranes of the microphone devices 41 and 42, these openings are provided with comparatively coarse mesh protective gratings 44 and 45. These can if necessary be glued onto the housing afterwards after the assembly of the relevant hearing aid device 43 and if necessary can be removed again correspondingly easily.

As well as the advantages already mentioned, the inventive arrangement has the further advantage that the membrane is not directly accessible from outside and therefore for example cannot be touched accidentally with the fingers. On the one hand this avoids unpleasant noises caused by touching it and in addition the membrane is better protected from mechanical stress than would be the case for a membrane disposed on the surface of the device.

In addition the arrangement shown has a further advantage: The receive point of a microphone usually lies roughly in the middle of each sound entry opening in the housing of a device concerned. Since only comparatively little space is required on the housing surface in the invention in relation to the desired membrane surface, the sound entry openings belonging to different microphones can lie very close to one another. Therefore acoustically very short microphone arrays, i.e. microphones with a small acoustically-relevant spacing can be constructed.

The invention claimed is:

1. In combination with a microphone disposed in vicinity of a sound inlet opening, a microphone protective device, comprising:

a membrane disposed for preventing a penetration of dirt and/or moisture into the sound inlet opening of the microphone, said membrane having characteristics selected from the group of being dirt-repelling, moisture-repelling, dirt-impermeable, and moisture-impermeable;

said membrane being formed at least partly in a shape of a cylindrical shell; and an outer envelope at least partly enveloping said membrane, said membrane and said outer envelope defining a double wall tube.

2. The microphone protective device according to claim 1, wherein said outer envelope is formed at least partly in the shape of a cylindrical shell.

3. The microphone protective device according to claim 1, wherein said membrane and said outer envelope are aligned relative to one another with a substantially common axis of symmetry, said common axis of symmetry is a common axis of said membrane and said outer envelope.

4. The microphone protective device according to claim 1, wherein said membrane and said outer envelope have mutually different diameters and/or are spaced apart from one another, defining a spacing distance between said membrane and said envelope.

5. The microphone protective device according to claim 1, wherein said membrane and said outer envelope have a substantially equal height in a direction along a longitudinal axis of said membrane.

6. The microphone protective device according to claim 1 wherein, at least at one end of the cylindrical shell of said membrane and said envelope, an area between said membrane and said outer envelope is provided with a terminating element.

7. The microphone protective device according to claim 6, wherein said terminating ring is an annular ring.

8. The microphone protective device according to claim 6, wherein said terminating element is formed in one piece with said outer envelope.

9. The microphone protective device according to claim 1, which comprises a cover element disposed at at least one end of said membrane.

10. The microphone protective device according to claim 1, wherein said outer envelope is formed with a microphone connection opening.

11. A microphone unit, comprising a microphone and a microphone protective device according to claim 1 disposed to protect said microphone.

12. The microphone unit according to claim 10, wherein said microphone protective device further comprises an outer envelope at least partly enveloping said membrane and said microphone includes a microphone housing embodied in one piece with said outer envelope.

13. A hearing aid device, comprising the microphone protective device according to claim 1.

14. The hearing aid device according to claim 13, which further comprises a microphone disposed to be protected by said microphone protective unit.

15. The hearing aid device according to claim 13, comprising a housing with a left housing side and a right housing side, wherein a first open end of the membrane opens out into said left housing side and/or a second open end of the membrane opens out into said right housing side.

16. The hearing aid device according to claim 13, wherein said microphone protective device further comprises an outer envelope at least partly enveloping said membrane and said outer envelope is embodied in one piece with the housing of the hearing aid device.

17. The hearing aid device according to claim 1, wherein said membrane is tubular and only an open end of said membrane is disposed at a cylindrical shell surface.

18. In combination with a microphone disposed in vicinity of a sound inlet opening of a hearing aid device, a microphone protective device, comprising:

a membrane disposed for preventing a penetration of dirt and/or moisture into the sound inlet opening of the microphone, said membrane having characteristics selected from the group of being dirt-repelling, moisture-repelling, dirt-impermeable, and moisture-impermeable;

said membrane being constructed with the membrane being displaced into the hearing device and with only an end of said membrane being disposed on a cylindrical shell surface; and an outer envelope at least partly enveloping said membrane, said membrane and said outer envelope defining a double wall tube.

19. In combination with a microphone disposed in vicinity of a microphone connection opening, a microphone protective device, comprising: a membrane disposed for preventing a penetration of dirt and/or moisture into the s microphone connection opening of the microphone, said membrane having characteristics selected from the group of being dirt-repelling, moisture-repelling, dirt-impermeable, and moisture-impermeable; and said membrane being formed as a tube having one end being disposed inside a cylindrical shell surface of a shell, said tube having a longitudinal extent extending from said shell surface toward the microphone connection opening.

* * * * *